US006357050B2

(12) United States Patent
Thompson

(10) Patent No.: US 6,357,050 B2
(45) Date of Patent: Mar. 19, 2002

(54) APPARATUS FOR FACILITATING THE APPLICATION AND REMOVAL OF WADERS

(76) Inventor: Michael R. Thompson, 16460 Hwy. 3, #906, Webster, TX (US) 77598

( * ) Notice: Subject to any disclaimer, the term of this patent is extended or adjusted under 35 U.S.C. 154(b) by 0 days.

(21) Appl. No.: 09/781,013

(22) Filed: Feb. 9, 2001

Related U.S. Application Data

(60) Provisional application No. 60/182,039, filed on Feb. 11, 2000.

(51) Int. Cl.[7] ..... A41D 13/00
(52) U.S. Cl. ..... 2/82; 2/69
(58) Field of Search ..... 2/82, 227, 242, 2/230, 232, 79, 69, 46; 36/1.5, 109, 2 R

(56) References Cited

U.S. PATENT DOCUMENTS 3,268,914 A * 8/1966 Barber ..... 2/82
4,912,860 A * 4/1990 Keller ..... 2/227 X
5,081,718 A * 1/1992 Carman et al. ..... 2/227
RE34,662 E * 7/1994 Keller ..... 2/82
5,867,828 A * 2/1999 Shih ..... 2/82
6,154,884 A * 12/2000 Dehner ..... 2/69
6,167,571 B1 * 1/2001 Cheng ..... 2/82

* cited by examiner

*Primary Examiner*—Gloria M. Hale
(74) *Attorney, Agent, or Firm*—Harrison & Egbert

(57) ABSTRACT

An apparatus for facilitating the application and removal of wader boots including a torso portion, a first leg member and a second leg member all being formed of a porous spun high-density polyethylene fiber material having a rough interior surface and a slick exterior surface. The first and second leg members are attached to the bottom of the torso portion. The torso portion extends at least as high as the height of the wader boots on a human torso. The torso portion has an elastic section secured thereto above the leg members. First and second boots are affixed to the bottoms of the first and second leg members. The first and second boots are also formed of the porous spun high-density polyethylene fiber material.

20 Claims, 3 Drawing Sheets

FIG. 4
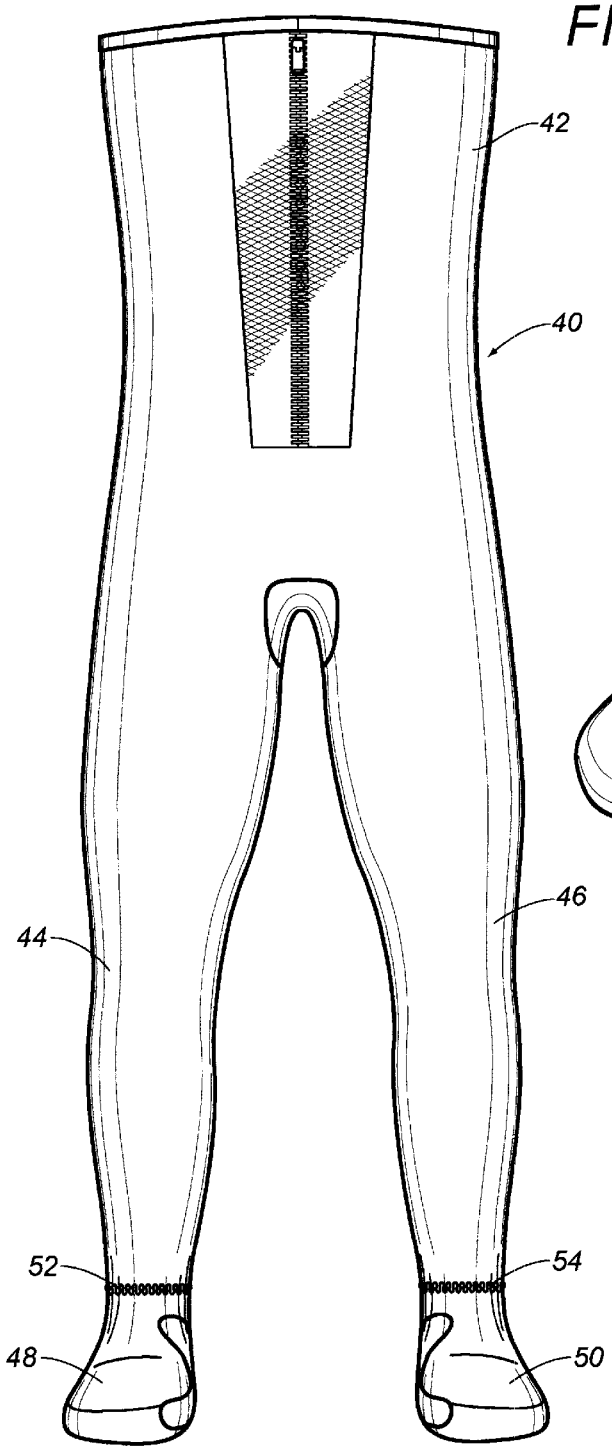
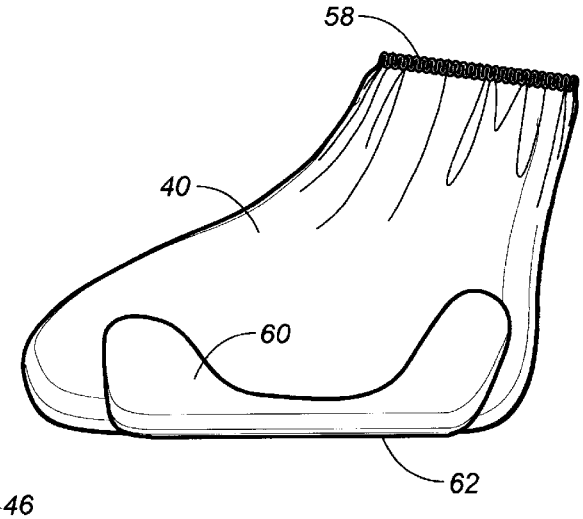
FIG. 5

APPARATUS FOR FACILITATING THE APPLICATION AND REMOVAL OF WADERS

CROSS-REFERENCE TO RELATED APPLICATIONS

The present utility patent application is based upon U.S. Provisional Patent Application Ser. No. 60/182,039, filed on Feb. 11, 2000, and entitled "METHOD AND APPARATUS FOR FACILITATING THE APPLICATION AND REMOVAL OF WADERS", presently pending.

BACKGROUND OF THE INVENTION

1. Field of the Invention

The present invention relates to waders and wader boots. More particularly, the present invention relates to articles that facilitate the application and removal of such waders or wader boots.

2. Description of Related Art

The use of wader-type protective clothing in conjunction with water sports such as fishing or crabbing, and specifically fly fishing, is well known and widely adopted. The waders are generally manufactured of a waterproof fabric. One type of wader, generally referred to as a "hip boot" style, is two boots which extend up to the thigh and are generally supported by attaching them to the wearer's belt. A second style of wader is the waist-high wader. These waders are generally one-piece waders that extend up to and sometimes slightly above the waist of the wearer. Finally, there is a full chest wader, that extends up to the arm pits of the wearer and is typically supported by shoulder straps.

FIG. 1 illustrates an example of such wader boots. As can be seen, the wader boots are attached along the chest, lower torso portion and legs of the fisherman 1. The waders 2 include chest portion 3, waist portion 4, leg members 5 and 6 and boots 7 and 8. Conventionally, the waders 2 are formed of a rubber or neoprene material. Shoulder straps may be attached to the chest portion 3 so as to extend over the shoulders of the fisherman 1.

All waders, especially neoprene waders, are difficult to put on or take off because of the high friction material that they are made of. The difficulty can also depend on how high they have to be worn on the body and the layers of clothing (coveralls, insulated undergarments, protective clothing, etc.) that are worn by the wearer. These waders are also used by hunters, emergency personnel, fish and wildlife department personnel, parks and recreation department personnel, and similar persons. Layers of clothing are always worn inside the waders. The layers of clothing and the material which make up the waders makes it very difficult to put the waders on and to take them off. Importantly, many people drown in waders because they either fall into a deep hole bringing the water line above the waders or by flooding and sinking the victim to the bottom in an inverted position. Sometimes, the persons that wear the waders will fall in swift-moving water such that the waders are filled with water. Waders made of neoprene are especially difficult to take off when flooded. Because of the amount of time it takes to remove the waders, many people have drowned. As such, it is desirable to either construct the waders so as to be easily removed or to develop other techniques so that the drowning of the wearers of such waders can be prevented.

In the past, many patents have issued relating to such waders and/or the application and removal of such waders. For example, U.S. Pat. No. 3,268,914 teaches a waterproof garment having leg members with boots affixed at the bottom of the leg members. The leg members extend upwardly to a waist area. Suitable buttons and fasteners are applied to the waist area so as to secure the waterproof garment around the waist of the user.

U.S. Pat. No. 4,912,860, issued on Apr. 3, 1990 to R. W. Keller, teaches a wader for use in fishing having a body portion covering the lower body (including the legs, feet, hips and waist of the wearer), and a chest portion normally folded inside the body portion but extendable upward about the chest, but not the shoulders of the wearer. The chest portion is preferably held about the chest by a drawstring, such as an elastic drawstring, and is biased into the lowered position inside the body portion by means of a seam joining the two portions.

U.S. Pat. No. 5,022,096, issued on Jun. 1, 1991 to D. J. Pacanowsky, teaches a multi-component, waterproof, breathable wader comprising left and right panels, each panel having a shape of a legging with an upper and lower region. The upper regions of the right and left panel are joined together at a seam running from front to back. There is a means for supporting the seamed panels on a person. This means is attached to the upper regions of each panel. The front and back regions of each panel are joined to form pant legs. Socks are attached to the lower region of each pant leg by a seam. The means for supporting the seamed panels on a person include belts or suspenders.

U.S. Pat. No. 5,081,718, issued on Jan. 21, 1992, to Carmen et al., teaches a pants-type garment that is provided with a leg portion made from a substantially unitary stretchable piece of material which is symmetric about a center fold. The unitary piece of material defines a pattern containing a first V-shaped recessed cut and a second V-shaped recessed cut about the midpoint of the pattern where the crotch portion is to be located. The crotch is at the center fold of the pattern piece between the two V-shaped recessed cuts. A substantially rectangular upper portion is attached to the leg portion by a seam which runs along the first and second sides of the V-shaped recessed cuts.

U.S. Pat. No. 5,826,274, issued on Oct. 27, 1998 to the present inventor, describes a method and apparatus for facilitating the application and removal of a wetsuit. This apparatus includes a torso portion with a first arm member and a second arm member extending outwardly from opposite sides of the torso portion. The first and second leg members extend downwardly from the torso portion. The torso portion, the leg members and the arm members are formed of a spun high density polyethylene fiber material. First and second boots are also formed of the same material and are removably affixed adjacent to the first and second leg members, respectively. U.S. Pat. Nos. 4,438,531, 5,480,455 and 5,829,057 teach various low friction materials that can facilitate the attachment of certain clothing items.

It is an object of the present invention to provide a liner which facilitates the application and removal of waders.

It is another object of the present invention to provide a liner which can serve to prevent the wearer of such waders from drowning.

It is a further object of the present invention to provide a liner which serves as a protective layer and serves to retain body heat.

It is another object of the present invention to provide a liner which prevents the pant legs of the wearer from rolling up the legs while applying the waders.

It is still a further object of the present invention to provide a liner which makes the waders more comfortable to wear.

It is still a further object of the present invention to provide a liner which prevents the felt in felt lined waders from being worn off by the clothing of the wearer.

It is still a further object of the present invention to provide such a liner which is easy to use, relatively inexpensive and easy to manufacture. These and other objects and advantages of the present invention will become apparent from a reading of the attached specification.

BRIEF SUMMARY OF THE INVENTION

The present invention is a liner for use in the wearing of waders. The liner is in the nature of a body suit that is intended to be worn directly over the body of the user. Additionally, the liner of the present invention is also configured so as to be worn directly over the clothing of the wearer of the wader boots. The liner of the present invention will reside between the layer of clothing of the wearer and within the waders. This liner is made of a porous, uncoated spun high-density polyethylene fiber material, commonly known as TYVEK (TM) material.

The liner of the present invention is a body suit which includes a lower torso member and first and second leg members. The lower torso member should have a size which accommodates the desired size of the waders. For example, if chest-high waders are to be worn, then the lower torso portion of the liner should extend to at least the height of the chest-high waders. If waist-high waders are worn, then the lower torso portion of the liner should extend to at least as high as the waist of the wearer. Generally, the lower torso portion of the liner will cover the abdomen of the wearer. The first and second leg members extend downwardly from the lower torso portion so as to receive human legs therein. Within the concept of the present invention, boots can be removably or unremovably attached to the end of the leg members opposite the torso portion.

In the present invention, the lower torso portion includes an elastic section attached around the waist area of the of the lower torso portion. The zipper extends downwardly from this elastic section. The zipper is also placed on an elastic section which is located on a frontal portion of the lower torso portion. This elastic section will reside within a cut-out area on the front of the liner. If desired, a flap can extend over the zipper on the front of the lower torso portion.

If boots are used with the liner apparatus of the present invention, then these boots can either be permanently attached or detachably attached to the leg members. If they are detachably affixed to the bottom of the leg members, then the bottom of the leg members will have an elastic section at the areas of the ankles of the wearer. The boots will also have an elastic top edge so as to snugly engage the ankles of the wearer. The boots will includes a non-skid bottom surface located on the instep of each of the boots. The boots can also be integrally attached to the bottom of the legs of the liner. The porous, uncoated spun high-density polyethylene fiber material will inherently have a rough side and a slick side. Within the concept of the present invention, the liner will be worn such that the rough side is adjacent to the human body and the slick side will face toward the waders. The waders can be placed over the slick side of the liner.

The present invention solves all of the problems associated with wearing wader boots by making it incredibly easy to put the waders on or to take the waders off. This easy application and removal can occur whether the waders are wet, dry or flooded. The liner is worn over the clothes and is large enough to accommodate overalls, heavy socks, or other protective clothing. The invention possesses an extremely low friction and drag coefficient which enables the wearer to slide into and out of the neoprene, cotton-lined, felt or canvas-lined waders effortlessly. This saves time and energy. As a result, the liner of the present invention enables waders to be donned or doffed much faster than ever before. This is very important if the waders should ever flood and fill with water. The present invention enables wearers to take off waders with life-saving speed if the wearer should sink under water. As such, the present invention can prevent drowning and can prevent the user from being stuck in mud or caught by underwater debris, such as tree branches. The present invention provides another layer of protective clothing and serves to retain body heat in frigid water. The present invention prevents the pants legs of the wearer from rolling up while donning the waders. As a result, it makes the waders much more comfortable to wear. The slick surface of the liner of the present invention will prevent the felt in felt-lined waders from being worn off by bulky clothing. As such, the present invention can save the expense of having the waders re-felted.

BRIEF DESCRIPTION OF THE SEVERAL VIEWS OF THE DRAWINGS

FIG. 4 is a frontal view of an alternative form of the present invention having detachable boots.

FIG. 5 is an isolated side view of the detachable use as used with the embodiment shown in FIG. 4.

DETAILED DESCRIPTION OF THE INVENTION

Figure 1:
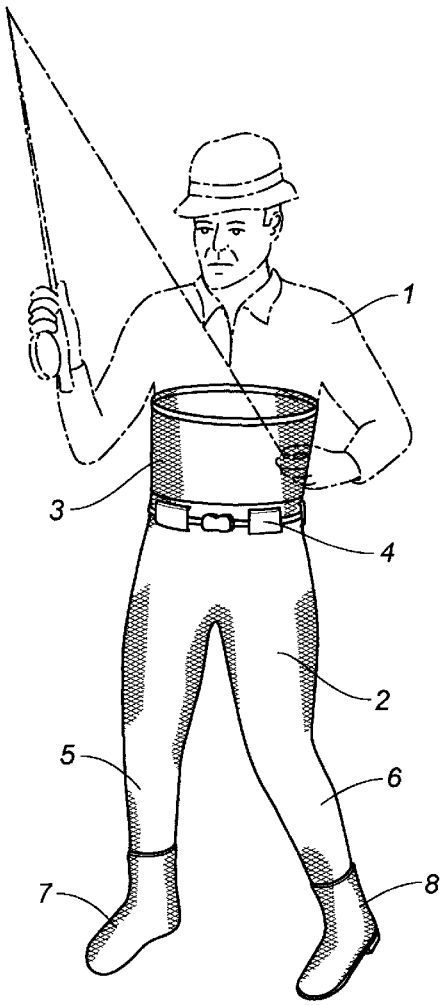
FIG. 1 Prior Art
FIG. 1 is an illustration of a prior art wader as applied to a human being.
Figure 2:
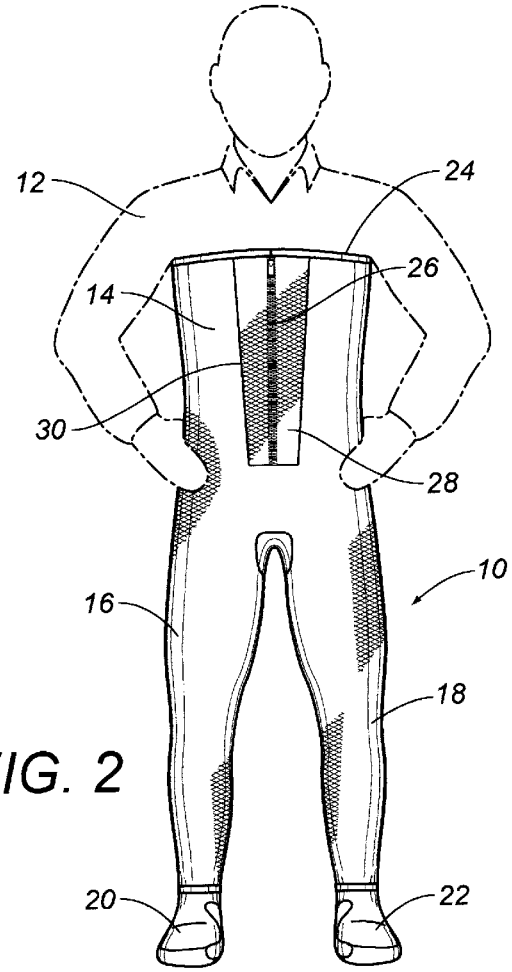
FIG. 2 is a frontal view showing the liner apparatus of the present invention as applied to a human being.

Referring to FIG. 2, there is shown at 10 the liner apparatus of the present invention as applied to the body of a human being 12. In particular, the liner apparatus 10 includes a lower torso portion 14 and leg members 16 and 18. The leg members 16 and 18 extend downwardly from the lower torso portion 14. Boots 20 and 22 are integrally affixed to the lower end of leg members 16 and 18, respectively.

In FIG. 2, it can be seen that the lower torso portion 14 extends upwardly along the chest of the user 12 to an area just below the arm pits of the user 12. As such, the apparatus 10 is designed for use with chest-high waders. The top edge 24 of the lower torso portion 14 will have an elastic band extending therearound. As such, the elastic band will assure a tight engagement between the upper end of the lower torso portion 14 and the chest of the user 12. A zipper 26 extends downwardly from this upper edge 24. The zipper 26 can be pulled downwardly so as to easily remove the liner apparatus 10. When the zipper 26 is pulled upwardly, the liner apparatus 10 will be securely affixed around the body of the user 12. The zipper 26 is affixed to an elastic material 28 on each side. The elastic material 28 can be sewn, or otherwise adhered, within a cutout area 30 formed on the forward surface of the lower torso portion 14. The elasticity of the section 28 will facilitate flexibility and maneuverability by the user 12. The zipper 26 and the elastic material 28 will extend downwardly so as to terminate adjacent to the waist of the user 12.

As can be seen in FIG. 2, the user 12 will have his or her legs inserted within leg members 16 and 18. Similarly, the user 12 will have his or her feet received within the boots members 20 and 22.

Importantly, the lower torso portion 14, the leg members 16 and 18, and the boots 20 and 22 are formed of a porous, uncoated spun high-density polyethylene fiber material. This material is otherwise known as TYVEK™, a non-woven multi-directional fibrous fabric, high-density polyethylene formed by a continuous process from very fine 0.5-10 micrometer fibers. These non-directional fibers (plexifilaments) are first spun and then bonded together by heat and pressure, without binders or fillers. This material offers a balance of physical characteristics that combine some of the properties of paper, film and cloth. The material contains an antioxidant which provides an oxidative life in excess of 20 years. This creates a new form of plastic material with properties different from those of low-density polyethylene. It allows air to flow freely between the person 12 and the waders without having to perforate the material. Additionally, high-density polyethylene retains its structural integrity so as to render it a stronger material than low-density polyethylene. This prolongs the life span of the material. Since the properties of the high-density polyethylene are similar to normal woven fabrics, including the properties of softness, loose flexibility and a porous structure, the liner apparatus 10 adds a comfort value. The material used for the formation of the liner apparatus 10 assures that the material has slick properties on the outside and adhesive properties on the inside. This is achieved without coating or otherwise materially altering the high-density polyethylene material.

Figure 3:
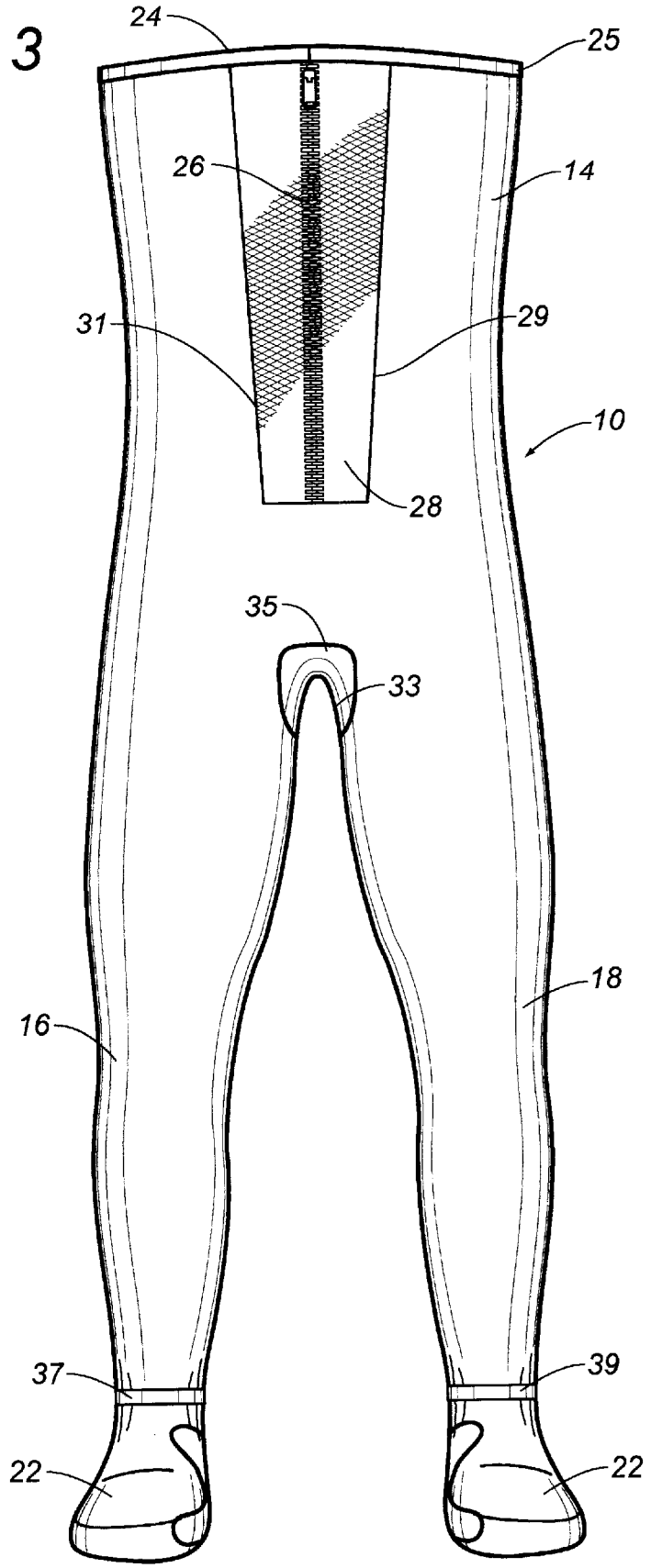
FIG. 3 is an isolated frontal view of the liner apparatus of the present invention with permanently attached boots.

FIG. 3 is an isolated view of the liner apparatus 10. In FIG. 3, it can be seen that the top edge 24 has an elastic band 25 extending therearound. Zipper 26 extends downwardly from the upper edge 24. A three-inch wide elastic panel 28 is secured to the edges 29 and 31 of the lower torso portion 14 of the apparatus 10. This elastic material 28 (or other material with stretch-like properties) adds to the comfort and snugness of the lower torso portion 14 and also serves to relieve stress on the garment in this area. The elasticity of the material 28 can prevent any tearing of the lower torso portion 14.

In FIG. 3, it can be seen that the crotch area 33 includes an elastic section 35. This elastic section 35 in the crotch area 33 adds to the comfort of the garment in this area and serves to relieve physical stress from the garment in this area. The leg members 16 and 18 extend downwardly from the lower torso portion 14. Boots 20 and 22 are shown as integrally attached to the bottom of the leg members 16 and 18, respectively. If desired, an elastic band 37 can be formed at the area between the bottom of leg member 16 and the top of boot 20. Another elastic band 39 can be formed in the area between the bottom of leg member 18 and the top of boot 22. Such an elastic band can serve to hold the liner apparatus 10 in place and to prevent the feet of the user from sliding or becoming displaced within the boots 20 and 22. Each of the boots 20 and 22 will have an anti-skid pad on the instep of the bottom of each foot so as to prevent slippage. This anti-skid pad is located on the instep of the boots 20 and 22. An illustration of such an anti-skid pad can be seen in FIG. 5.

FIG. 4 shows an alternative embodiment 40 of the liner apparatus of the present invention. The liner apparatus 40 has a lower torso portion 42 and leg members 44 and 46 extending downwardly therefrom. Unlike the embodiment shown in FIGS. 2 and 3, the boots 48 and 50 are removably secured to the bottoms 52 and 54 of the leg members 44 and 46, respectively.

In this embodiment, the bottom 52 of leg member 44 will have an elastic band thereacross. This elastic band will help to secure the bottom of the leg member 44 in its desired position around the ankles of the user. The boot 48 can have another elastic band along its upper edge so as to be secured in proximity to or over the bottom 52 of the leg member 44. The other boot member 50 will have a similar configuration.

FIG. 5 is an isolated side view of the boot member 48. As can be seen, the boot member 48 includes an elastic band 58 located along its upper edge. An anti-skid pad 60 of a generally U-shaped configuration is placed along the bottom 62 of the boot 48. The anti-skid pad is generally positioned so as to correspond with the instep of the foot placed within the boot 48.

The foregoing disclosure and description of the invention is illustrative and explanatory thereof. Various changes in the details of the illustrated configuration can be made within the scope of the present invention without departing from the true spirit of the invention.

I claim:

1. An apparatus for facilitating the application and removal of wader boots comprising:

a torso portion formed of a porous spun high-density polyethylene fiber material having a rough surface and a slick surface, said slick surface being on an exterior of said torso portion;

a first leg member connected to a bottom of said torso portion and extending downwardly therefrom, said first leg member being formed of a porous spun high-density polyethylene fiber material having a rough surface and a slick surface, said slick surface being on an exterior of said first leg member; and a second leg member connected to a bottom of said torso portion and extending downwardly therefrom on a side of said first leg member, said second leg member being formed of a porous spun high-density polyethylene fiber material having a rough surface and a slick surface, said slick surface being an exterior of said second leg member.

2. The apparatus of claim 1, said torso portion and said first and second leg members being integrally defined together.

3. The apparatus of claim 1, said torso portion having an interior area having sufficient size to accommodate a human torso therein, said torso portion having a height of a sufficient length so as to extend at least to a height of the wader boots on a human torso.

4. The apparatus of claim 1, said torso portion having an elastic section secured thereto and positioned above said first and second leg members.

5. The apparatus of claim 4, said torso portion having a cut-out area in a forward surface thereof, said elastic section being affixed to said torso portion in said cut-out area.

6. The apparatus of claim 4, said elastic section having a zipper extending vertically thereon, said zipper being movable between a first position closing said elastic section and a second position opening said elastic section.

7. The apparatus of claim 1, further comprising:

a first boot affixed to said first leg member, said first boot being formed of a spun high-density polyethylene fiber material having a rough surface and a slick surface, said slick surface being on an exterior of said first boot; and a second boot affixed to said second leg member, said second boot being formed of a porous spun high-density polyethylene fiber material having a rough surface and a slick surface, said slick surface being on an exterior of said second boot.

8. The apparatus of claim 7, said first boot being removably affixed to said first leg member, said second boot being removably affixed to said second leg member.

9. The apparatus of claim 8, each of said first leg member and said second leg member having an elastic section formed at a bottom thereof, each of said first boot and said second boot having an elastic section formed at a top thereof, said elastic section of said leg members being in respective overlapping relationship with said elastic sections of said boots.

10. The apparatus of claim 7, each of said first and second boots having a non-skid surface affixed to a bottom thereof.

11. An apparatus comprising:

wader boots formed of an elastomeric or rubber material, said wader boots having a torso section with first and second legs extending downwardly therefrom; and a liner positioned interior of said wader boots, said liner being formed of a spun high-density polyethylene fiber material, said liner having a torso portion positioned within said torso section of said wader boots, said liner having first and second leg members connected to said torso portion and extending interior of respective said first and second legs of said wader boots.

12. The apparatus of claim 11, said liner being separable from said wader boots.

13. The apparatus of claim 11, said torso section of said wader boots having a top edge, said torso portion of said liner having a top edge at least as high as said top edge of said torso section.

14. The apparatus of claim 11, said liner having a roughened surface and a slick surface, said slick surface facing said wader boots.

15. The apparatus of claim 11, further comprising:

a human having clothing thereover, said liner having an interior of sufficient size extending loosely over an exterior of said clothing, said liner interposed between said clothing and said wader boots.

16. The apparatus of claim 11, said torso portion having an elastic section secured thereto and positioned above said first and second leg members.

17. The apparatus of claim 16, said elastic section having a zipper extending vertically thereon, said zipper being movable between a first position closing said elastic section and a second position opening said elastic section.

18. The apparatus of claim 11, said wader boots having first and second boot members affixed to respective bottoms of said first and second legs, said liner further comprising:

a first boot affixed to said first leg member, said first boot being formed of a spun high-density polyethylene fiber material, said first boot positioned interior of said first boot member of said wader boots; and a second boot affixed to said second leg member, said second boot being formed of a spun high-density polyethylene fiber material, said second boot being positioned interior of said second boot member of said wader boots.

19. The apparatus of claim 18, said first boot being removably affixed to said first leg member, said second boot being removably affixed to said second leg member.

20. The apparatus of claim 19, each of said first leg member and said second leg member having an elastic section formed at a bottom thereof, each of said first boot and said second boot having an elastic section formed at a top thereof, said elastic sections of said first and second leg members being in overlapping relationship with said elastic section of said first and second boots.

* * * * *